United States Patent [19]

Nicoll, Sr. et al.

[11] Patent Number: 4,890,760

[45] Date of Patent: Jan. 2, 1990

[54] TRASH RECEPTACLE WITH VACUUM BREAKING MEANS

[76] Inventors: Douglas Nicoll, Sr.; Tammy Nicoll, both of 3801 Piping Rock La., Virginia Beach, Va. 23452

[21] Appl. No.: 338,150

[22] Filed: Apr. 14, 1989

[51] Int. Cl.[4] ..... B65D 90/34

[52] U.S. Cl. ..... 220/404; 220/1 T

[58] Field of Search ..... 220/1 T, 410, 403, 404, 220/400; 137/854; 248/95, 99–101

[56] References Cited

U.S. PATENT DOCUMENTS

| | | | |
|---|---|---|---|
| 1,408,356 | 2/1922 | Jones | 137/854 X |
| 1,959,263 | 5/1934 | Crashe | 220/404 |
| 3,191,798 | 6/1965 | White et al. | 220/404 |
| 3,356,100 | 12/1967 | Seeler | 137/854 X |
| 3,403,696 | 10/1968 | Pynchon . | |
| 3,422,985 | 1/1969 | Rinehart | 220/404 X |
| 3,454,182 | 7/1969 | Morton . | |
| 3,815,778 | 6/1974 | Martin . | |
| 4,054,225 | 10/1977 | Frech | 220/404 |
| 4,254,602 | 3/1981 | Boynton . | |
| 4,294,379 | 10/1981 | Bard . | |
| 4,459,793 | 7/1984 | Zenger | 220/404 X |

FOREIGN PATENT DOCUMENTS 2919670 5/1979 Fed. Rep. of Germany .

*Primary Examiner*—Bryon P. Gehman

*Attorney, Agent, or Firm*—Shlesinger & Myers

[57] ABSTRACT

A trash receptacle including a valve mounted in the bottom thereof for breaking a suction which is created when the trash liner positioned within the receptacle is lifted for the purposes of trash removal. The valve is mounted in the central, raised bottom portion of the container. The central portion forms a recess portion and is surrounded by a periperal portion having radially extending passages. The valve includes a flexible diaphragm the peripheral portion of which remains in sealing engagement with the inside surface of the container and covers the air holes extending from the outside surface to the inside surface of the container. When the liner is lifted, the diaphragm flexes upwardly due to the suction pressure and allows air to flow inwardly to break the suction.

6 Claims, 1 Drawing Sheet

TRASH RECEPTACLE WITH VACUUM BREAKING MEANS

FIELD AND HISTORICAL BACKGROUND OF THE INVENTION

The present invention is directed to trash receptacles and more particularly to a trash receptacle with means for breaking the vacuum which is created when the flexible plastic liner disposed therein is removed after being filled with refuse material.

Conventionally, trash or other refuse material is collected and bagged in a flexible plastic liner placed within a rigid, upstanding receptacle. Typically, in residential and commercial trash collection, however, it has been observed that the plastic liner due to its flexible nature tends to cling to the inside wall of the trash receptacle, and as the trash liner is progressively filled with refuse material, the liner further clings to the trash receptacle wall and ultimately substantially fills the space defined by the receptacle wall. During this process, any air present between the liner and the receptacle wall slowly leaks out, and when the trash-filled liner occupies the interior space of the receptacle, a vacuum is created between the trash liner and the receptacle wall and the receptacle base portion lying beneath the liner. Accordingly, when a user lifts the trash liner, the suction pressure due to the vacuum counteracts removal of the trash liner. This necessarily makes it difficult to remove the trash liner from the trash receptacle.

A few examples of various trash receptacles and valve means are disclosed in U.S. Pat. Nos. 3,403,696; 3,454,182; 3,815,778; 4,254,602; 4,294,379, and German No. 2,919,670. However, these receptacles are complicated in design and relatively expensive to manufacture.

OBJECTS AND SUMMARY OF THE INVENTION

The principal object of the present invention is to provide a trash receptacle with a vacuum breaking means which is simple in construction and design and therefore relatively inexpensive to manufacture.

An additional object of the present invention is to provide a trash receptacle with a vacuum breaking means which overcomes the disadvantages associated with conventional trash receptacles.

Yet an additional object of the present invention is to provide a trash receptacle with a vacuum breaking means which makes it easy to lift the flexible plastic liner placed therein for collecting and removing refuse material.

Another object of the present invention is to provide a trash receptacle with a vacuum breaking means which breaks the suction created between the plastic liner and the trash receptacle bottom and wall.

In summary, the main object of the present invention is to provide a trash receptacle that includes means for breaking the suction created when the plastic liner is lifted out therefrom for the purposes of removing trash material.

BRIEF DESCRIPTION OF THE DRAWINGS

The above and other objects and advantages and novel features of the present invention will become apparent from the following detailed description of the preferred embodiment of the invention illustrated in the accompanying drawings, in which.

DETAILED DESCRIPTION OF THE INVENTION

Figure 1:
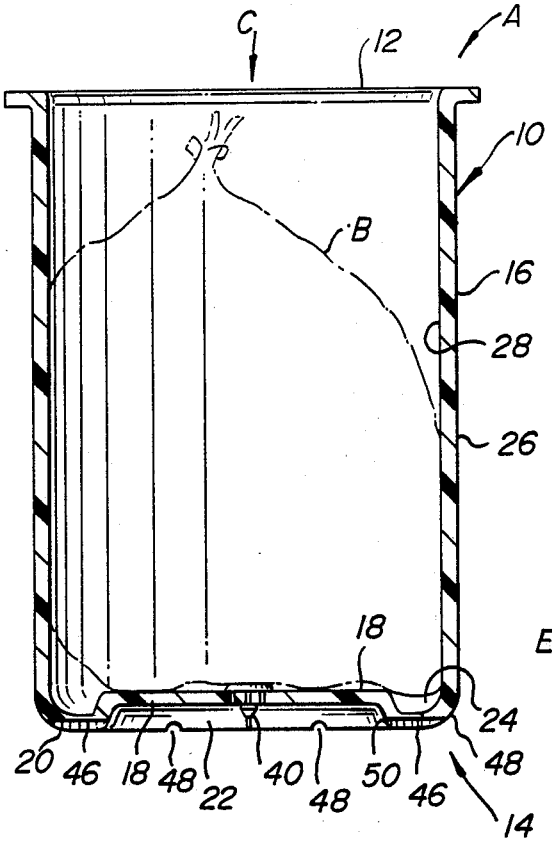
FIG. 1 is a partially sectional view of the trash receptacle of the invention showing in broken lines a trash liner placed therein.
Figure 2:
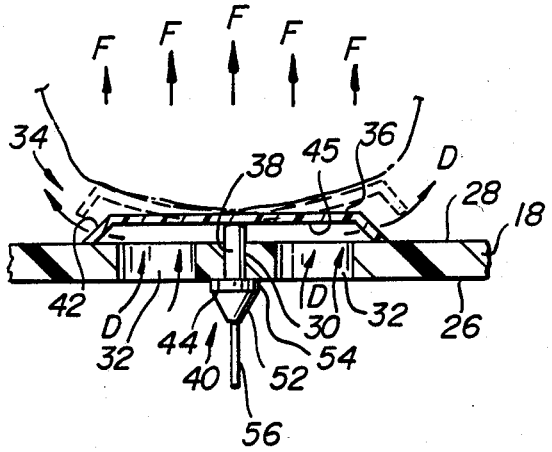
FIG. 2 is an enlarged partial view of the receptacle shown in FIG. 1, and further showing in phantom lines the position of the valve upon lifting of the trash liner.

As generally indicated in FIG. 1 by A, the trash receptacle of the present invention includes an upstanding container 10 having an open top 12 and a closed bottom 14, and a generally impervious side wall 16. Trash container 10, as shown in FIGS. 1 and 2, is made of a plastic material, however, it should be noted that other conventional material may be used for making the same. It should further be noted that the size of the trash container 10 may be varied to accommodate the use thereof in different applications, i.e., in commercial and residential applications.

As shown in FIG. 1, a flexible, removable plastic liner B has been placed within trash container 10 for collecting therein trash or other refuse material. The container bottom 14 includes a raised central section 18 and an outer peripheral section 20. Central section 18 is recessed inwardly and defines a circular concave or recess portion 22 communicating with the exterior. In other words, if one were to look inside into trash container 10 towards its bottom 14, indicated by arrow C, prior to placing liner B therein, one would see a raised central section 18 and a peripheral groove 24 surrounding the central section 18. When trash container 10 is placed upstanding on a support surface (not shown), outer peripheral section 20 provides principle support for trash receptacle A.

The container 10 includes an outside surface 26 and an inside surface 28 and central section 18 includes a vertically extending vent 30 extending between outside and inside surfaces 26 and 28. Inside surface 28 is preferably made smooth in the adjoining areas of vent 30.

Figure 4:
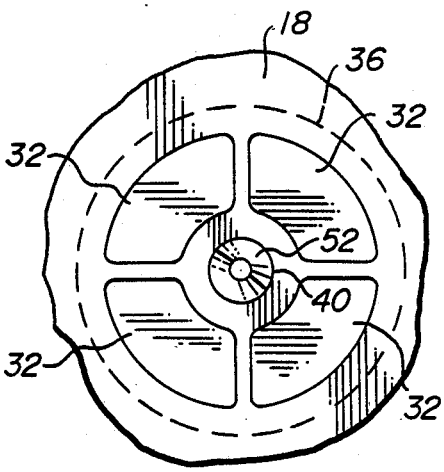
FIG. 4 is an enlarged view of the central portion of FIG. 3 showing the vent details.

As shown in FIGS. 2 and 4, central section 18 also includes four equilaterally spaced air holes 32 which are arranged in a circular fashion around vent 30 and extend from outside surface 26 to inside surface 28.

As best shown in FIG. 2, a mushroom shaped valve 34 including a generally flexible circular diaphragm 36 is secured against inside surface 28 about the central axis of vent 30 by its stem 38 and button 40. Valve 34 is mounted such that peripheral section 42 of diaphragm 36, that extends downwardly at an angle, engages with inside surface 28, and button inside surface 44 engages outside surface 26 and stem 38 extends therebetween. It should be noted that due to the weight of trash material, the entire diaphragm 36 may come to engage with a portion of inside surface 28 lying directly beneath it.

Valve 34 is preferably made of a suitable flexible, rubber-like material that allows diaphragm 36 to bend or flex as shown by phantom lines in FIG. 2. Preferably, inside surface 45 of diaphragm 36 is made smooth. The diameter of diaphragm 36 is larger than the diameter of a circle formed by air holes 32 such that when diaphragm 36 is in sealing engagement with inside surface 28, no air may leak into trash container 10 from the exterior through air holes 32. Likewise, when diaphragm 36 flips upwardly, shown in phantom lines in FIG. 2, due to a suction pressure created by removal of trash liner B, air enters through air holes 32 into the interior of trash container 10, as peripheral section 42 of diaphragm 36 is no longer in sealing engagement with inner surface 28 (shown by arrows D).

Figure 3:
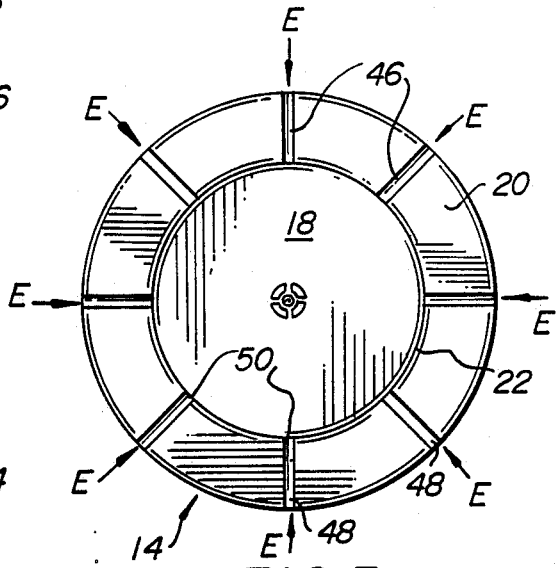
FIG. 3 is a bottom plan view of FIG. 1.

Under normal circumstances, trash container 10 would be placed on a support surface such that outer peripheral section 20 would be flush therewith. Accordingly, the amount of air that may enter into trash container 10 via air holes 32 would be limited to the air trapped in recess portion 22 when the container 10 is placed on the support surface. Therefore, radially extending passages 46 are provided on bottom 14 of the container in outer peripheral section 20 thereof (FIG. 3). The passages 46 are equilaterally spaced and each includes an outer opening 48 communicating with the exterior and an inner opening 50 communicating with recess portion 22. Thus, when liner B is lifted and diaphragm 36 takes the position shown in FIG. 2 by phantom lines, the air enters from the exterior into recess portion 22 via passages 46, shown by arrows E in FIG. 3.

As shown in FIG. 2, button 40 includes downwardly inclined surface 52 and vertically extending peripheral wall 54 extending between button surface 44 and inclined surface 52. A small flexible portion 56 is provided which after securing valve 34 may be torn-off for aesthetic reasons. The inclined wall 52 and flexible portion 56 facilitate threading of stem 38 in vent 30. In other words, valve 34 is positioned into vent 30 by first threading portion 56 through vent 30 such that it extends beyond outside surface 26 and is then pulled downwardly until button 40 forces its way through and beyond outside surface 26 so that button surface 44 comes into engagement therewith. It should be noted that it is a relatively easy procedure since valve 34 is made of a flexible, rubber-like material.

USE AND OPERATION

In use, typically liner B is plated within trash receptacle A which is then progressively filled with trash or other refuse material. Initially, trash liner B due to its flexible nature does not immediately take-up the shape of the interior of the receptacle, however, as it gets filled with trash material, it begins to bulge and acquires the shape of the receptacle. At the same time, any air present between trash liner B and inside of side wall 16 slowly leaks out. Accordingly, when liner B is lifted in the direction shown by arrows F in FIG. 2, a suction is created in the areas lying beneath the trash liner B and in the areas adjoining side wall 16 of trash receptacle A, which causes diaphragm 36 to flip-up, shown in phantom lines in FIG. 2, so that it is no longer in sealing engagement with inside surface 28. When this happens, the air from the exterior enters via passages 46 into recess portion 22 and in the area beneath trash liner B thereby breaking the suction created. The breaking of the suction facilitates removal of trash liner B from inside of trash oontainer 10. Once the suction has been broken and trash liner B is removed from the trash receptacle A, diaphragm 36, due to its inherent nature and memory, returns back to its normal position, i.e., its peripheral section 42 engaging with inside surface 28, to thereby be in sealing engagement therewith. And the trash receptacle is now ready for another use.

While this invention has been described as having a preferred design, it is understood that it is capable of further modifications, uses and/or adaptations of the invention and following in general the principle of the invention and including such departures from the present disclosure as may come within the known or customary practice in the art to which the invention pertains, and as may be applied to the central features hereinbefore set forth, and fall within the scope of the invention or the limits of the claims appended hereto.

What we claim is:

1. A trash receptacle for receiving a flexible, removable plastic liner, comprising:

(a) said receptacle being upstanding and having an open top and a closed bottom and an impervious side wall;

(b) said bottom having an outer peripheral area and a central area;

(c) said bottom having an inside surface and an outside surface;

(d) said central area having a concavity in said outside surface;

(e) said peripheral area providing principal support means for said receptacle when positioned upright on a support surface;

(f) said central area having a vent extending from said inside surface to said outside surface of said bottom;

(g) said bottom inside surface i the area of said vent having a smooth surface;

(h) valve means for sealing said vent and including a flexible circular diaghragm and means for securing said diaphragm against said smooth inside surface in the area of said vent;

(i) said vent including means engageable with said diaphragm securing means for securing said valve means in said vent and for maintaining said flexible diaphragm when positioned in said vent in normal sealable engagement with said inside surface of said bottom;

(j) said diaphragm having a concavity facing said smooth inside surface;

(k) said circular diaphragm having its entire periphery engageable with said smooth inside surface and under compression at all times to form a seal between said diaphragm and said smooth surface to prevent fluid from escaping from inside the bottom of the receptacle to the exterior of the receptacle under normal loading of trash in said liner; and (1) said diaphragm being sufficiently flexible so that said diaphragm will disengage from said smooth surface when a flexible liner positioned in said trash receptacle and which clings to the receptacle wall is lifted for the purposes of removal to permit air to enter into and pass from the outside through said vent thereby breaking the suction created upon removal of said liner.

2. The receptacle of claim 1, wherein:

(a) said vent comprising a plurality of openings.

3. The receptacle of claim 2, wherein:

(a) said openings including a central opening and a plurality of peripherally arranged openings.

4. The receptacle of claim 1, wherein:

(a) said diaphragm securing means including a stem having a deformable retainer button.

5. The receptacle of claim 1, wherein:

(a) said bottom peripheral area including a plurality of radially extending passages in said outside surface of said bottom.

6. The receptacle of claim 5, wherein:

(a) said passages communicating with the exterior at one end and opening into said central area at another end thereof.

* * * * *